US008562317B2

(12) United States Patent
Fujioka et al.

(10) Patent No.: US 8,562,317 B2
(45) Date of Patent: Oct. 22, 2013

(54) SCROLL EXPANSION MACHINE WITH AIR FLOW PASSAGE AROUND OUTER PERIPHERY OF SEALING SURFACE

(75) Inventors: Tamotsu Fujioka, Yokohama (JP); Atsushi Unami, Yokohama (JP)

(73) Assignee: Anest Iwata Corporation (JP)

( * ) Notice: Subject to any disclaimer, the term of this patent is extended or adjusted under 35 U.S.C. 154(b) by 240 days.

(21) Appl. No.: 13/149,247

(22) Filed: May 31, 2011

(65) Prior Publication Data

US 2011/0300012 A1 Dec. 8, 2011

(30) Foreign Application Priority Data

Jun. 2, 2010 (JP) ..... 2010-126762

(51) Int. Cl.
*F01C 1/02* (2006.01)
*F03C 2/00* (2006.01)
*F04C 2/00* (2006.01)

(52) U.S. Cl.
USPC ..... 418/55.1; 418/15; 418/55.4; 418/55.6; 418/85; 418/92; 418/101

(58) Field of Classification Search
USPC ..... 418/15, 55.1–55.6, 57, 85, 91–92, 101
See application file for complete search history.

(56) References Cited

U.S. PATENT DOCUMENTS

| | | | | |
|---|---|---|---|---|
| 3,134,369 | A * | 5/1964 | Schlor | 418/101 |
| 5,417,554 | A * | 5/1995 | Kietzman et al. | 418/101 |
| 6,190,145 | B1 * | 2/2001 | Fujioka et al. | 418/101 |
| 7,329,108 | B2 * | 2/2008 | Tsuchiya et al. | 418/101 |
| 2008/0152525 | A1 * | 6/2008 | Tsuchiya et al. | 418/55.1 |

FOREIGN PATENT DOCUMENTS

| | | | |
|---|---|---|---|
| JP | 10026090 | A * | 1/1998 |
| JP | 2007-032291 | A | 2/2007 |

* cited by examiner

*Primary Examiner* — Theresa Trieu
(74) *Attorney, Agent, or Firm* — Rossi, Kimms & McDowell LLP

(57) ABSTRACT

The rotating shaft is connected to the generator; the high-pressure steam s is introduced to the expansion chamber b through the guide passage; when the energy of the high-pressure steam s during expansion process revolves the revolving scroll, the generator regenerates electric power. The connecting housing is provided with the inlet opening and the outlet opening; the ventilation blades are fitted to the rotating shaft. When the ventilation blades rotate, the outside air is introduced (inside of the housing) from and through the inlet opening; the air passes by the air opening and the backside of the revolving scroll, and is discharged through the outlet opening. Thus, by the approach that the air passage is formed inside of the connecting housing and the scroll housing, the high-pressure steam s is prevented from being directed toward the backside of the revolving scroll.

4 Claims, 4 Drawing Sheets

SCROLL EXPANSION MACHINE WITH AIR FLOW PASSAGE AROUND OUTER PERIPHERY OF SEALING SURFACE

BACKGROUND OF THE INVENTION

1. Field of the Invention

The present invention relates to a scroll expansion machine in which high pressure fluid that is introduced in the machine is prevented from flowing out from an expansion chamber in order that the configuration members of the machine is not adversely affected by the flowing-out fluid.

2. Background of the Invention

In a scroll expansion machine in which high pressure fluid is fed into an expansion chamber where the high pressure fluid is expanded, the energy of the high pressure fluid expanding in the expansion process is used for revolving a revolving scroll; thereby, the scroll expansion machine is provided with the revolving scroll having a spirally formed lap thereof and a fixed scroll having a spirally formed lap thereof, the lap of the revolving scroll and the lap of the fixed scroll being meshed with each other so as to form the expansion chamber. Further, the energy of the revolving movement regarding the revolving scroll is, for example, used as the energy for compressing gas. Or, the revolving movement of the revolving scroll is transmitted to a generator via a rotating shaft so as to regenerate electric power.

In comparison with an expansion machine provided with a turbine, the advantageous points are that the scroll expansion machine can be smaller scale equipment, and the machine can be driven with a smaller power; thus, the machine can advantageously regenerate power. Or, the expansion machine can be supplied to land facilities so that the electric power obtained by the high-pressure steam that is introduced in the scroll expansion machine is sent to the utility power grid (transmission network). Patent Reference 1 discloses an expansion machine provided with such a regeneration generator.

REFERENCES

Patent References

Patent Reference 1: JP2007-32291

SUMMARY OF THE INVENTION

Subjects to be Solved

On the sealing surface regarding the expansion chamber formed by the revolving scroll and the fixed scroll, the dust seal used in the scroll compressor or the dynamic seal such as P-seal that makes use of contact pressures is fitted.

Into the expansion chamber, the high pressure fluid of a pressure level from 0.5 MPa to 1.0 MPa is usually introduced in the machine; after the high pressure fluid expands and accomplishes mechanical work, the steam is depressurized into a state of a pressure slightly higher than the atmospheric condition pressure and discharged outside of the housing of the machine. Thereby, through the sealing surfaces regarding the revolving scroll and the fixed scroll, a small amount of the fluid leaks out.

In a case where the high pressure fluid is steam or the like, when the steam flows out of the expansion chamber and condenses into water, the rotation shaft or the bearing device of the rotation prevention mechanism may become rusty; the condensed water may get mixed with the lubricant such as grease so that the lubricant may flow out due to the reduced viscosity of the lubricant; or, the lubricant may be emulsified. In order to completely seal the sealing surface regarding the expansion chamber, a sealing mechanism of a large scale is required; further, there is another problem that the life of such a sealing mechanism is reduced.

In view of the difficulties of the conventional technology as described above, the present invention aims at evading the problems such as the rust occurring in the devices in the machine housing, the leakage of the lubricant and the emulsification of the lubricant, by use of a problem evading means that does not accompany cost increase.

Means to Solve the Subjects

In order to solve the above-described problems, the present invention discloses a scroll expansion machine including, but not limited to:

a fixed scroll that includes, but not limited to, a mirror-surface plate and a spiral lap, the spiral lap being set-up on the mirror-surface plate;

a revolving scroll that includes, but not limited to, a mirror-surface plate and a spiral lap, the spiral lap being set-up on the mirror-surface plate, the spiral lap of the revolving scroll and the scroll lap of the fixed scroll meshing with each other so that an expansion chamber is formed;

a rotation prevention mechanism that prevents the rotation movement of the revolving scroll;

a rotating shaft that rotates in response to the revolution movement of the revolving scroll; and, a generator that is connected to the rotating shaft and regenerates electric power, at least one inlet opening that is provided at a housing that is arranged between the revolving scroll and the generator;

at least one outlet opening that is provided on the side of the fixed scroll;

an air passage that guides air from the inlet opening to the outlet opening via a space around the rotating shaft, the space being outside of the outer periphery of the sealing surface formed between the revolving scroll and the fixed scroll; and a blower that introduces outside air into the air passage from the inlet opening, wherein the electric power is regenerated by an expansion energy of high-pressure steam that is introduced into the expansion chamber, wherein airflow is formed via the air passage from the inlet opening to the outlet opening, by use of the blower.

In this way, the fluid that has expanded and leaks out through the sealing surface can be discharged outside of the housing, without being directed toward the backside of the revolving scroll as well as without approaching the backside of the revolving scroll.

As described above, according to the present invention, the blower introduces the outside air inside of the housing toward the backside of the revolving scroll; an airflow is formed so that the airflow passes by the space outside of the outer periphery of the sealing surface formed between the revolving scroll and the fixed scroll, after the airflow passes by the revolving scroll; then, the air introduced by the blower is discharged out of the housing.

Owing to the wind pressure of the airflow, the depressurized (expanded) fluid that leaks out from the sealing surface is directed toward not the backside of the revolving scroll but the outside of the housing. Thus, the rust caused by the corrosive fluid in the apparatus such as the rotating shaft and the bearing device of the rotation prevention mechanism can be prevented; a phenomenon in which the condensed water is mixed with the lubricant, the lubricant including the water flows out or the lubricant is emulsified can be eliminated.

A preferable embodiment of the present invention is the scroll expansion machine, wherein the housing is a connecting housing that is arranged in the space between the revolving scroll and the generator;

the rotating shaft is arranged so that the rotating shaft penetrates the inside space of the connecting housing in order to transmit the rotation movement in response to the revolving movement of the revolving scroll, to the generator;

the scroll expansion machine further includes, but not limited to:

a bearing device that supports the rotating shaft from the revolving scroll side;

a bearing device that supports the rotating shaft from the generator side; and the inlet opening that is arranged so as to face the bearing device on the generator side of the connection housing, wherein the airflow is formed via the air passage from the inlet opening to the outlet opening, so that the air passes by the space near the bearing device on the generator side, the space being between the rotation prevention mechanism and the bearing device on the revolving scroll side, and the space being outside of the outer periphery of the sealing surface, the outlet opening being arranged at a bottom end part of the a scroll housing surrounding the fixed scroll.

As described above, the depressurized (expanded) fluid that leaks out from the sealing surface is not directed toward the backside of the revolving scroll but discharged outside of the housing. Thus, the bearing devices can be prevented from getting rusty. Further, owing to the outside air introduced inside of the housing, the bearing devices can be cooled. Hence, even when the apparatus inside of the housing is heated up due to the steam of high temperature and high pressure, the apparatus can be cooled owing to the outside air. Accordingly the reliability of the device can be maintained Another preferable embodiment of the present invention is the scroll expansion machine, wherein the blower includes, but not limited to, a plurality of ventilation blades that is fixed to the rotating shaft, and the ventilation blades are rotated in response to the rotation movement of the rotating shaft so that the blower introduces outside air through the inlet opening.

In this way, the driving gear for the blower can be dispensed with; thus, the configuration of the blower can be simplified and the cost can be reduced. Accordingly, the air passage inside of the connecting housing can be easily arranged.

Another preferable embodiment of the present invention is the scroll expansion machine, wherein the blower being arranged on the outer periphery surface side of the housing so that the blower faces the inlet opening.

In this way, when the blower is arranged outside of the housing, the formation regarding the air passage inside of the housing can be easily achieved without being hindered by the arrangement of the blower. Further, the maintenance of the blower can be easily performed by the manner of arranging the blower outside of the housing.

Further, the electric power regenerated by the generator can be a power source for driving the blower. Thus, the electric power needed for the blower can be saved.

Effects of the Invention

Based on the scroll expansion machine as per the present invention, the machine includes, but not limited to:

a revolving scroll that includes, but not limited to, a mirror-surface plate and a spiral lap, the spiral lap being set-up on the mirror-surface plate;

a revolving scroll that includes, but not limited to, a mirror-surface plate and a spiral lap, the spiral lap being set-up on the mirror-surface plate, the spiral lap of the revolving scroll and the lap of the fixed scroll meshing with each other so that an expansion chamber is formed;

a rotation prevention mechanism that prevents the rotation movement of the revolving scroll;

a rotating shaft that rotates in response to the revolution movement of the revolving scroll; and, a generator that is connected to the rotating shaft and regenerates electric power, the electric power being regenerated by the expansion energy of high-pressure steam that is introduced into the expansion chamber, wherein the scroll expansion machine further includes, but not limited to:

at least one inlet opening that is provided at a housing that is arranged between the revolving scroll and the generator;

at least one outlet opening that is provided on the side of the fixed scroll;

an air passage that guides air from the inlet opening to the outlet opening via the space around the rotating shaft, and the space outside of the outer periphery of the sealing surface formed between the revolving scroll and the fixed scroll; and, a blower that introduces outside air into the air passage from and through the inlet opening, and wherein airflow is formed via the air passage from the inlet opening to the outlet opening, by use of the blower.

In this way, the fluid that has expanded and leaks out through the sealing surface can be discharged outside of the housing, without being directed toward the backside of the revolving scroll as well as without approaching the backside of the revolving scroll.

Hence, the rust appearing on the apparatus such as the bearing devices arranged on the backside of the revolving scroll can be prevented; the leakage of the lubricant whose viscosity is reduced because of the mixing of the condensed water into the lubricant can be prevented; further, the problem regarding the emulsification of the lubricant because of the mixing of the condensed water into the lubricant can be eliminated. Moreover, the cooling of the apparatus by use of outside air can be performed. In this way, the reliability of the apparatus can be maintained.

BRIEF DESCRIPTION OF THE DRAWINGS

The present invention will now be described in greater detail with reference to the preferred modes of the invention and the accompanying drawings, wherein.

DETAILED DESCRIPTION OF THE PREFERRED EMBODIMENTS

Hereafter, the present invention will be described in detail with reference to the modes or the embodiments shown in the figures. However, the dimensions, materials, shape, the relative placement and so on of a component described in these modes or the embodiments shall not be construed as limiting the scope of the invention thereto, unless especially specific mention is made.

(First Mode)

Figure 1:
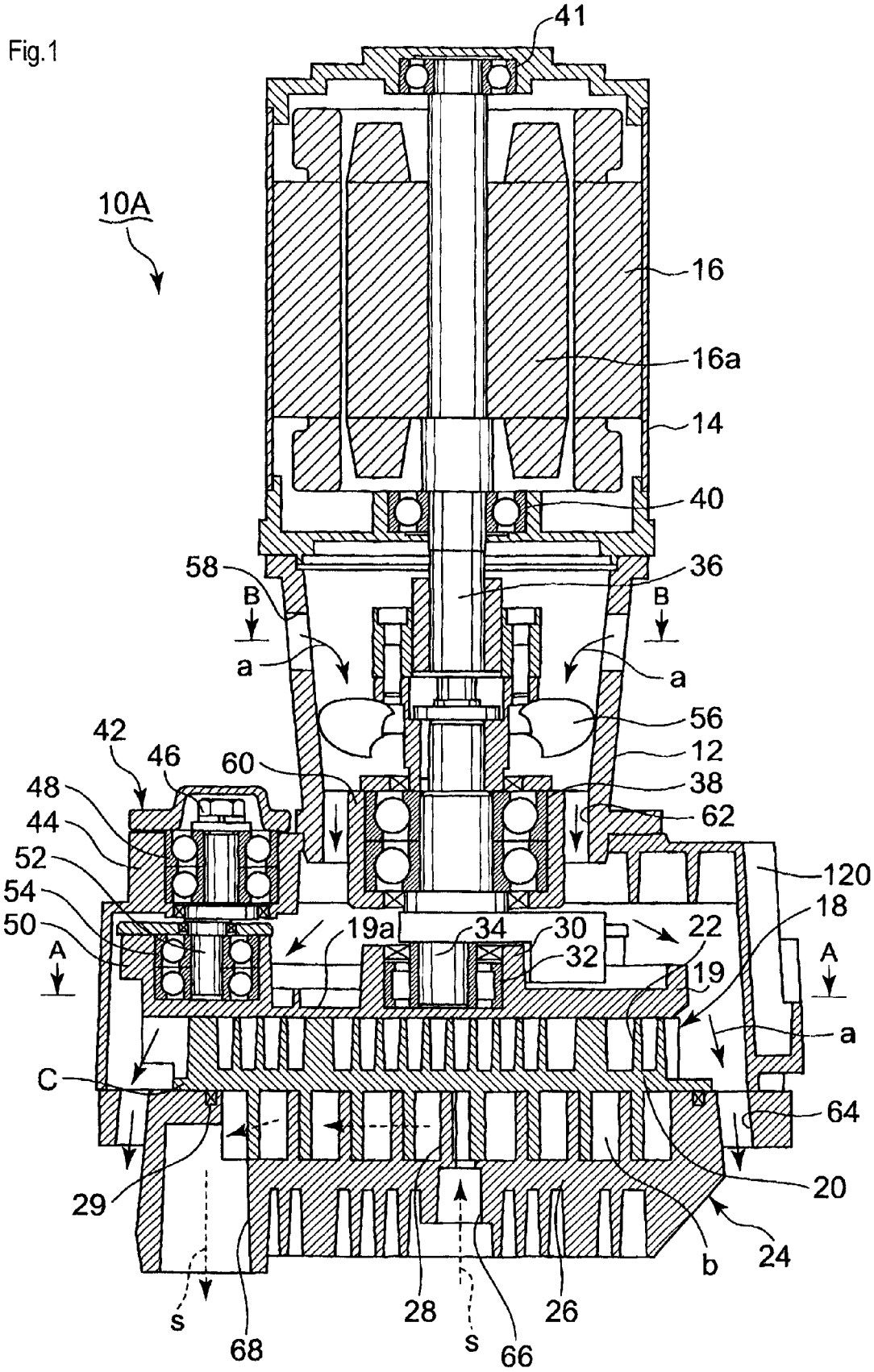
FIG. 1 shows a cross-section of a scroll expansion machine according to a first mode of the present invention, the cross section being parallel to a front view plane.
Figure 2:
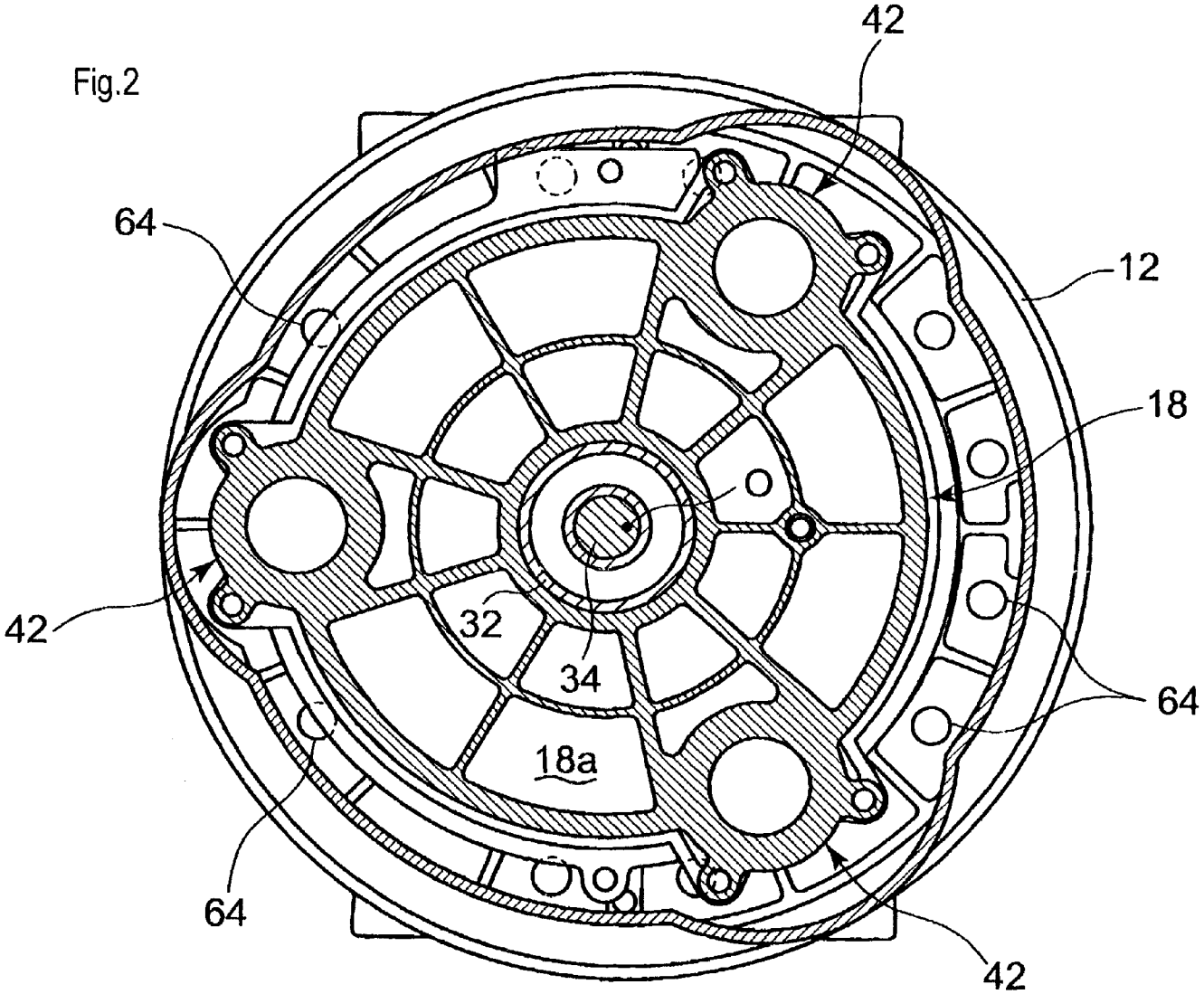
FIG. 2 shows an A-A cross-section in FIG. 1.
Figure 3:
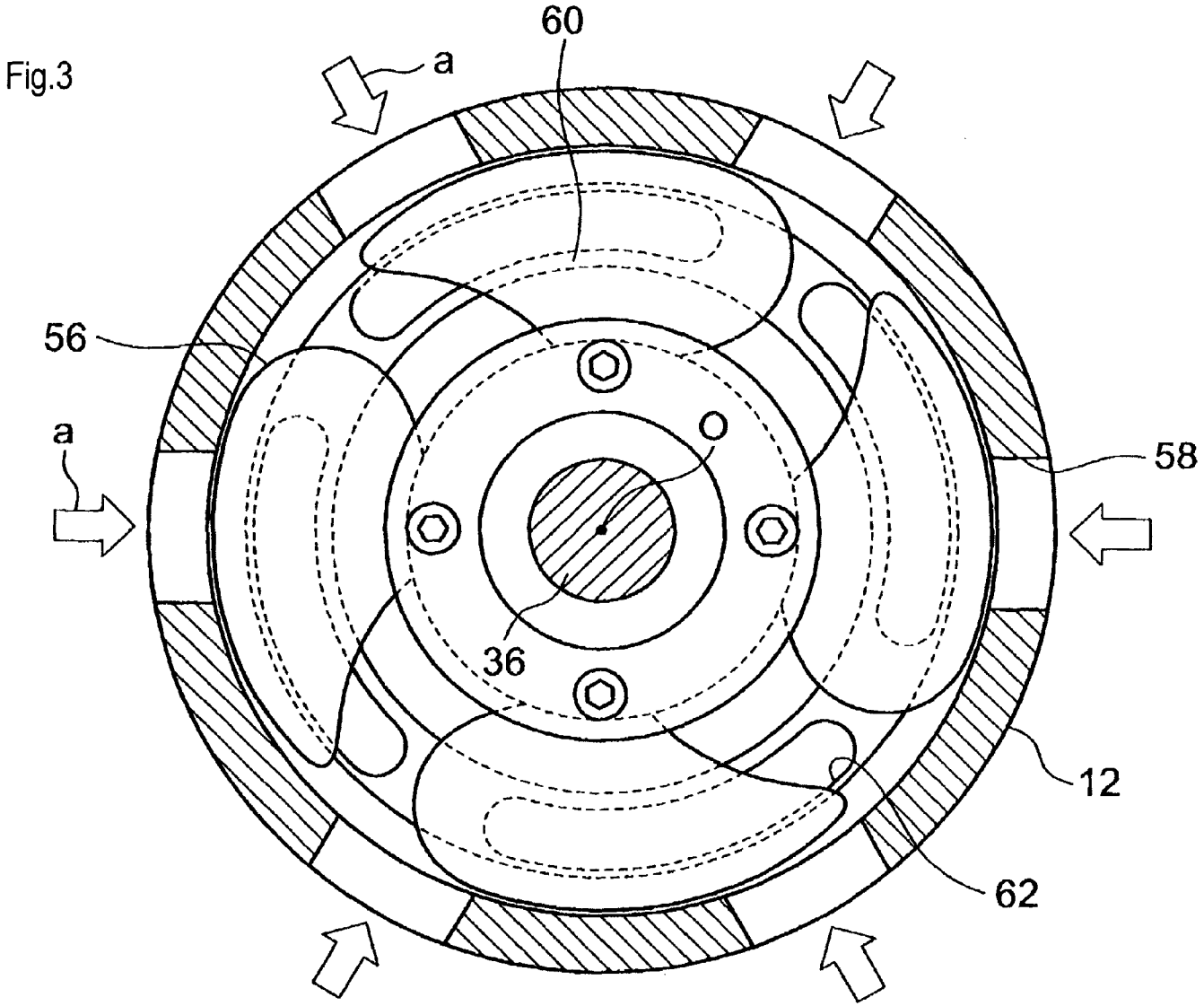
FIG. 3 shows a B-B cross-section in FIG. 1.

Based on FIGS. 1 to 3, the first mode of the scroll expansion machine according to the present invention is now explained. As shown FIGS. 1 to 3, the scroll expansion machine 10A according to the present mode includes, but not limited to:

a connecting housing 12 that is formed in a space between the revolving scroll 18 and the generator 16;

a rotating shaft 36 that passes through inside of the connecting housing 12 and transmits the revolution movement of the revolving scroll 18 to the generator;

a bearing device 38 that supports the rotating shaft 36 from the revolving scroll side; and, a plurality of inlet openings 58 that is arranged at a location of the connecting housing 12, the opening facing bearing device a bearing device 40.

Further, the inside of the connecting housing 12 is enclosed except for a plurality of inlet openings 58 and outlet openings 64, the outlet openings being described later. A generator casing 14 in which a generator 16 is incorporated is connected to the connecting housing 12, the generator casing 14 being placed on the connecting housing 12. The revolving scroll 18 and the fixed scroll 24 are arranged below the connecting housing 12. The revolving scroll 18 includes, but not limited to: a mirror-surface plate 20, and a spiral lap 22 that is installed upright in the mirror-surface plate 20. The fixed scroll 24 includes, but not limited to: a mirror-surface plate 26, and a spiral lap 28 that is installed upright in the mirror-surface plate 26.

The spiral lap 22 of the revolving scroll 18 and the spiral lap 26 of the fixed scroll 24 are arranged so as to face each other, the lap 22 and the lap 26 meshing each other so as to form an expansion chamber b. The revolving scroll 18 and the fixed scroll 24 come in contact with each other at a sealing surface C where a dust seal 29 is set between the scrolls 18 and 24.

A support plate 19 is securely installed on the backside of the revolving scroll 18. In the middle part on the backside of the supporting plate 19, a boss 30 is integrated with the support plate 19. In the boss 30, a sleeve 32 is inserted; an eccentric shaft 34 is fitted inside of the boss via the sleeve 32. The axis of the eccentric shaft 34 revolves eccentrically around the axis of a rotating shaft 36 arranged above the eccentric shaft 34, the rotating shaft 36 being integrated with the eccentric shaft 34. In the round cross-section of the eccentric shaft 34 depicted in FIG. 2, the rotation center O of the rotating shaft 36 is shown.

A bearing device 38 having at least one ball-roller bearing (ball bearing or roller bearing), a bearing device 40 having at least one ball-roller bearing, and a bearing device 41 having at least one ball-roller bearing rotation-freely support the rotating shaft 36; thereby, the bearing devices 40 and 41 are arranged in the generator casing 14. Further, on the backside 19*a* of the support plate 19, at least one rotation prevention mechanism 42 is provided so that the rotation movement of the revolving scroll 18 is constrained and the revolving scroll performs only revolution movement.

In relation to the rotation prevention mechanism 42, a shaft housing part 44 that is formed near to the connecting housing 12 rotation-freely supports a pin-crank shaft 46 via a bearing device 48 having at least one ball-roller bearing. In addition, on the backside 19*a* of the support plate 19, a shaft housing part 50 is provided so that the part 50 is integrated with the support plate 19. The shaft housing part 50 rotation-freely supports an eccentric pin 52 that is eccentrically connected to the pin-crank shaft 46, via a bearing device 54 having at least one ball-roller bearing.

Further, between the bearing device 38 and the bearing device 40 (on the side of the revolving scroll 18), at a height level below the inlet openings 58, a plurality of ventilation blades (4 blades) 56 is fitted to the outer periphery of the rotating shaft 36. In addition, the inlet openings 58 of a round hole are drilled on the outer periphery of the connecting housing 12, the openings being arranged along a hoop direction at a height level above the ventilation blades 56.

As shown in FIG. 3, a shaft housing 60 is provided so that the shaft housing part 60 is integrated with the connecting housing 12 and supports the bearing device 38; the lower part of the connecting housing 12 around the outer periphery of the shaft housing part 60 is provided with a plurality of air openings 62 of a bent track shape (a shape of an outer periphery of an arched oval-track) the openings which are drilled along the arc-shaped outer periphery (along the hoop direction) of the shaft housing part 60.

Further, as shown in FIGS. 1 and 2, a scroll housing 120 is fluid-tightly fitted to the connecting housing 12; thereby, the center axis of the connecting housing 12 agrees with the center axis of the scroll housing. Further, in the neighborhood of the outer periphery of the fixed scroll 24 as well as in the neighbor hood of the bottom part of the scroll housing 120, a plurality of outlet openings having a cross-section of a round shape is drilled; the outlet openings 64 are arranged in a hoop direction regarding the center axis of the scroll housing, along the outer periphery of the fixed scroll 24.

In the scroll expansion machine 10A as described above, when the high pressure fluid introduced into the scroll machine through the bottom middle part of the fixed scroll is, for example, high pressure steam s, then the high pressure steam s is supplied to the expansion chamber b; the energy of the high pressure steam makes the revolving scroll 18 revolve in response to the expansion process of the steam. Since the rotation movement regarding the revolving scroll 18 is constrained owing to the rotation prevention mechanism 42, the revolving scroll 18 performs only revolution movement; and, the revolution movement of the revolving scroll is transmitted toward the rotating shaft 36, via the eccentric shaft 34. Thus, the rotating shaft 36 and the rotor 16*a* of the generator 16 rotate so that the generator produces electric power.

Further, in response to the rotation movement of the rotating shaft 36, the ventilation blades 56 rotate; the movement of the ventilation blades 56 introduces the outside air a into the inside of the connecting housing 12. The outside air a introduced into the inside of the connecting housing 12 passes through the air opening 62 and streams along the backside of the revolving scroll 18; further, the outside air a passes by the rotation prevention mechanisms 42. Further, the outside air a streams along the outer periphery regarding the revolving scroll 18 and the fixed scroll 24, and is discharged through the outlet openings 64 toward the outside; the direction of the discharged air is downward and slightly outward from the center axis direction of the rotating shaft.

According to the present mode, in response to the wind pressure of the air-flow (regarding the outside air a) formed inside the scroll housing 120, the high pressure steam s that leaks out through the sealing surface streams downward without streaming toward the upper backside of the revolving scroll 18; and the leaked steam is discharged out of the scroll housing 120 through the outlet openings 64. Hence, the apparatus inside of the scroll housing, for example, the apparatus including the bearing devices 38, 40,48 and 54 on the backside of the revolving scroll can be free from the rust that is caused by the condensed water derived from the leakage steam s that has leaked through the sealing surface C. In addition, there can be no apprehension that the condensed water is mixed with the lubricant, the viscosity of the lubricant is reduced, the reduced viscosity aggravates the leakage of the lubricant, or the lubricant is emulsified.

In addition, according to the present mode, the air passage through which the outside air a streams is formed so that the air passes by the bearing device 38 of the rotating shaft 36 and the bearing device 48 of the rotation prevention mechanism 42; further, the flow of the outside air a is formed so that the flow of the air (the airflow) faces the outer periphery of the bearing device 54 and the sealing surface C. Thus, there can be an additional effect that the devices hereby described are cooled by the outside air a. Accordingly, even when the apparatus inside of the connecting housing 12 or the scroll housing 120 is heated up by the steam s of high temperature and high pressure, the temperature of the apparatus can be reduced. As a result, the reliability regarding the apparatus can be enhanced.

Further, since the ventilation blades 56 are fitted to the rotating shaft 36, the driving gear for the ventilation blades 56 can be dispensed with. Thus, the driving mechanism for driving the blades 56 can be simplified and the cost can be reduced. Accordingly, the air openings for the outside air a inside of the connecting housing 120 can be easily arranged.

Second Embodiment

Figure 4:
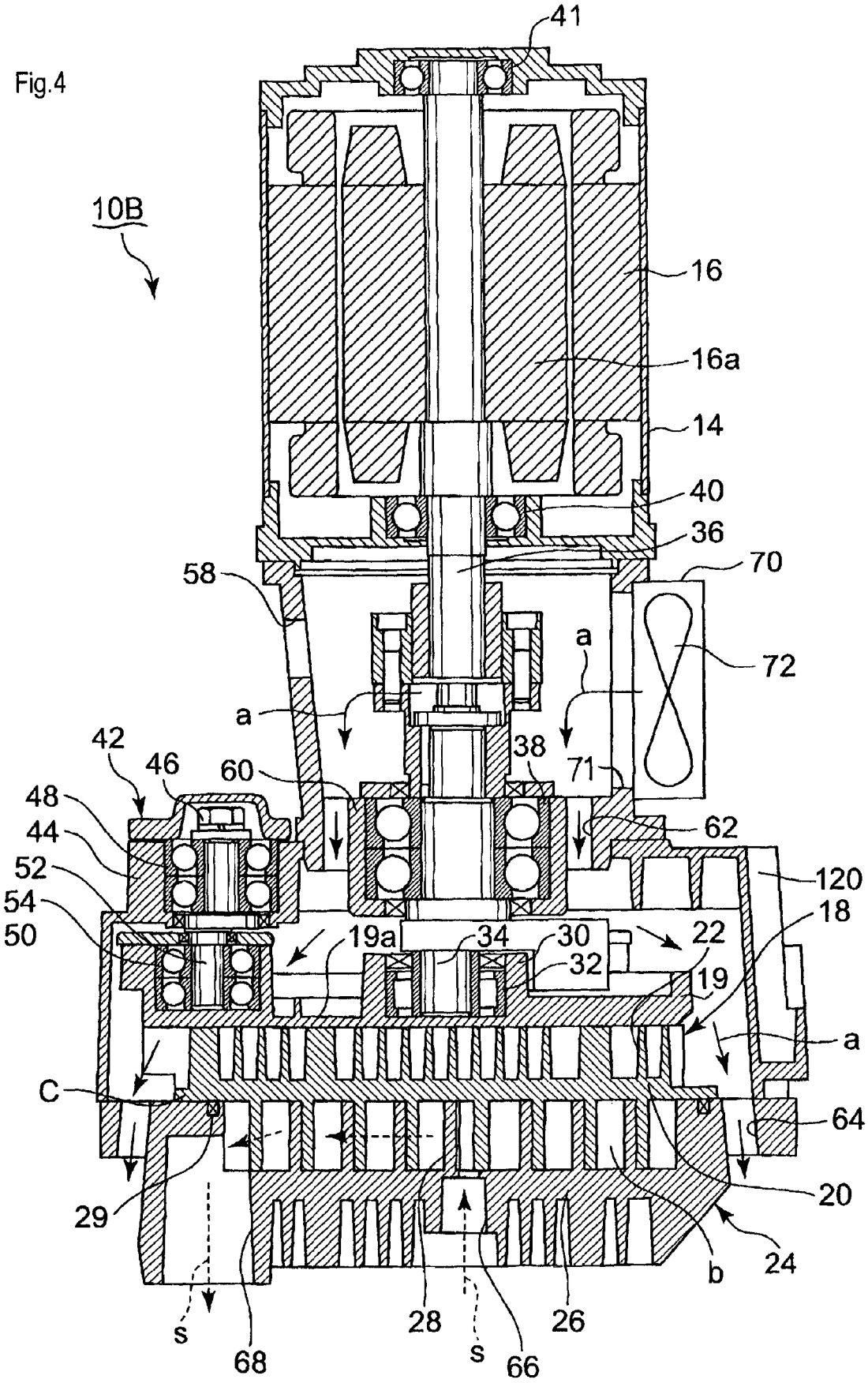
FIG. 4 shows a cross-section of a scroll expansion machine according to a second mode of the present invention, the cross section being parallel to a front view plane.

In the next place, based on FIG. 4, the second mode of the present invention is explained. A scroll expansion machine 10B according to the present mode includes, but not limited to, a blower 70 that is provided with a plurality of ventilation blades 72 and a drive motor (not shown), the blower 70 being fitted to the outer periphery wall of the connecting housing 12 provided at a location between the bearing device 38 and the generator casing 14. Further, the connecting housing 12 is provided with an inlet opening 71 whose diameter corresponds to the diameter of the ventilation blade 72, the inlet opening 71 being drilled on the outer periphery side wall of the connecting housing 12. Incidentally, the same components in the second embodiment as in the first embodiment are given common numerals; and, explanation repetitions are omitted.

According to the present mode, the blower 70 is arranged outside of the connecting housing 12; thus, the air passage inside of the connecting housing 12 be easily formed. Further, since the lower 70 is arranged outside of the connecting housing 12, the maintenance of the blower can be easily performed. Moreover, since the lower 70 is arranged outside of the connecting housing 12, a part of the electric power regenerated by the generator 16 can be used as the driving power for driving the blower 70. Thus, the electric power needed for the blower can be saved.

INDUSTRIAL APPLICABILITY

According to the present invention, even when a corrosive fluid as a high pressure fluid is introduced to a scroll expansion machine, the scroll expansion machine can be free from the problems such as the rust caused by the corrosive fluid in the apparatus in the machine, the leakage of the lubricant, and the emulsification of the lubricant. In this way, a scroll expansion machine can be realized in a simple and cost effective manner.

What is claimed is:

1. A scroll expansion machine comprising:

a fixed scroll that comprises a mirror-surface plate and a spiral lap, the spiral lap being set-up on the mirror-surface plate;

a revolving scroll that comprises a mirror-surface plate and a spiral lap, the spiral lap being set-up on the mirror-surface plate, the spiral lap of the revolving scroll and the spiral lap of the fixed scroll meshing with each other so that an expansion chamber is formed;

a rotation prevention mechanism that prevents the rotation movement of the revolving scroll;

a rotating shaft that rotates in response to the revolution movement of the revolving scroll;

a generator that is connected to the rotating shaft;

at least one inlet opening that is provided at a housing that is arranged between the revolving scroll and the generator;

at least one outlet opening that is provided on the side of the fixed scroll;

an air passage that guides air from the inlet opening to the outlet opening via a space around the rotating shaft, the space being outside of the outer periphery of a sealing surface formed between the revolving scroll and the fixed scroll; and a blower that introduces outside air into the air passage from the inlet opening such that the air passes from the inlet opening to the outlet opening, wherein the revolving scroll and the fixed scroll come in contact with each other at the sealing surface and a dust seal is set between the revolving scroll and the fixed scroll at the sealing surface.

2. The scroll expansion machine according to claim 1, wherein the housing is a connecting housing that is arranged in the space between the revolving scroll and the generator;

the rotating shaft is arranged so that the rotating shaft penetrates the inside space of the connecting housing in order to transmit the rotation movement in response to the revolving movement of the revolving scroll, to the generator;

the scroll expansion machine further comprising:

a bearing device that supports the rotating shaft from the revolving scroll side;

a bearing device that supports the rotating shaft from the generator side; and the inlet opening that is arranged so as to face the bearing device on the generator side of the connection housing, wherein the airflow is formed via the air passage from the inlet opening to the outlet opening, so that the air passes by the space near the bearing device on the generator side, the space being between the rotation prevention mechanism and the bearing device on the revolving scroll side, and the space being outside of the outer periphery of the sealing surface, the outlet opening being arranged at a bottom end part of the a scroll housing surrounding the fixed scroll.

3. The scroll expansion machine according to claim 1, wherein the blower comprises a plurality of ventilation blades that is fixed to the rotating shaft, and the ventilation blades are rotated in response to the rotation movement of the rotating shaft so that the blower introduces outside air through the inlet opening.

4. The scroll expansion machine according to claim 1, wherein the blower being arranged on the outer periphery surface side of the housing so that the blower faces the inlet opening.

* * * * *